US006527213B2

(12) United States Patent
Philippe et al.

(10) Patent No.: US 6,527,213 B2
(45) Date of Patent: Mar. 4, 2003

(54) SKEIN SUPPORT BOW

(75) Inventors: Thomas-Derevoge Philippe, Avon (FR); Jean Paul Ganaye, Sausheym (FR)

(73) Assignee: Dollfus Mieg & CIE —DMC, Paris (FR)

( * ) Notice: Subject to any disclaimer, the term of this patent is extended or adjusted under 35 U.S.C. 154(b) by 0 days.

(21) Appl. No.: 09/826,102

(22) Filed: Apr. 5, 2001

(65) Prior Publication Data

US 2001/0028009 A1 Oct. 11, 2001

(30) Foreign Application Priority Data

Apr. 5, 2000 (FR) ..... 00 04352
Sep. 12, 2000 (FR) ..... 00 11603

(51) Int. Cl.[7] ..... B65H 49/30; B65H 75/06; B65H 54/68

(52) U.S. Cl. ..... 242/127; 242/222; 242/472.7; 40/309

(58) Field of Search ..... 242/127, 613.3, 242/222, 472.7; 40/309, 299.01

(56) References Cited

U.S. PATENT DOCUMENTS 69,579 A * 10/1867 Palmer ..... 242/399
81,471 A * 8/1868 Brown ..... 242/127
97,198 A * 11/1869 Jennings ..... 242/613.3 X
506,130 A * 10/1893 Perkins ..... 242/613.3 X
1,249,536 A * 12/1917 Sorensen ..... 242/613.3 X
1,252,483 A * 1/1918 Pattison ..... 242/127 X
1,454,050 A * 5/1923 Gruenhagen ..... 242/613.3 X
2,165,021 A * 7/1939 Zink ..... 242/613.3 X
D145,503 S * 9/1946 Badgley ..... 242/613.3 X
D264,806 S * 6/1982 Russell ..... D8/358

* cited by examiner

*Primary Examiner*—Kathy Matecki
*Assistant Examiner*—Minh-Chau Pham
(74) *Attorney, Agent, or Firm*—Connolly Bove Lodge & Hutz LLP

(57) ABSTRACT

A skein support bow includes an elongated solid main section made of flexible material and has a length approximately equal to the length of a skein to be mounted thereon. Double hook members are located at each end of the elongated main section for engaging a corresponding loop end of the skein. An excrescence is integrally appending from the main section and forms a label hanger for receiving a label after the label is removed from the skein thereby making information on the label available after the skein is mounted to the bow.

3 Claims, 1 Drawing Sheet

SKEIN SUPPORT BOW

FIELD OF THE INVENTION

The present invention relates in general to assemblies of yarns folded over themselves in several turns (hereafter called a "skein") and allowing tidy separation of these yarns by creating a loop made in the skein (small hank). It relates more particularly to a bow intended to receive such a skein.

BRIEF DESCRIPTION OF THE INVENTION

The object of the invention is to provide an embroidery bow which allows the yarns to be mounted on it instantly without a winding phase being necessary and which has a ring holder intended to support the label bearing the reference of the colour of the skein.

For this purpose, the subject of the invention is a skein support bow having a length approximately identical to that of the skein and having the shape of a strip made of flexible material, characterized in that it terminates at each of its ends in a double hook capable of housing a loop of the said skein, the said strip including an excrescence, especially in its central part, of dimensions such that it can take a label on which a reference of the said skein is indicated.

According to one embodiment of the said bow, the said excrescence has a hole so as to catch the unused strands of yarn.

The subject of the invention is also a method of using a bow, applied to a held in position by means of labels going around the skein in its upper and lower parts, which consists in introducing one of the loops of the skein into one of the double hooks, then in removing the labels going around the skein and in passing the other free end of the skein into the second double loop.

Further features and advantages of the present invention will emerge from the description given below, with reference to the appended drawings which illustrate one embodiment thereof, devoid of any limiting character.

DETAILED DESCRIPTION OF THE INVENTION

Figure 1:
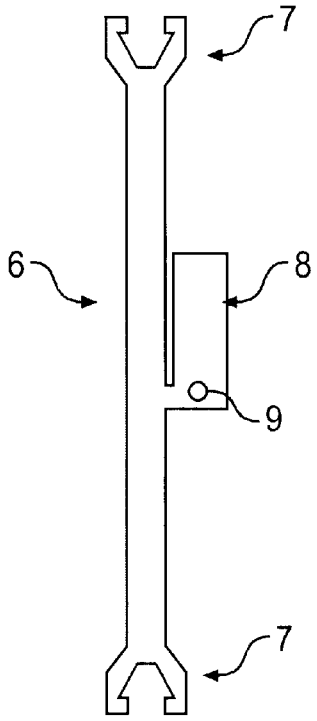
FIG. 1 is a plan view of the embroidery bow according to the invention.

As shown in FIG. 1, the bow forming the subject of the invention is in the form of a strip, preferably made of plastic or the like, which terminates at each of its ends in a double hook 7 capable of housing a loop 5 of the skein 4. To do this, the said bow has a length approximately identical to that of the said skein and the material of which it is made is flexible so as to make it easier for the said skein to be mounted on it.

Figure 2:
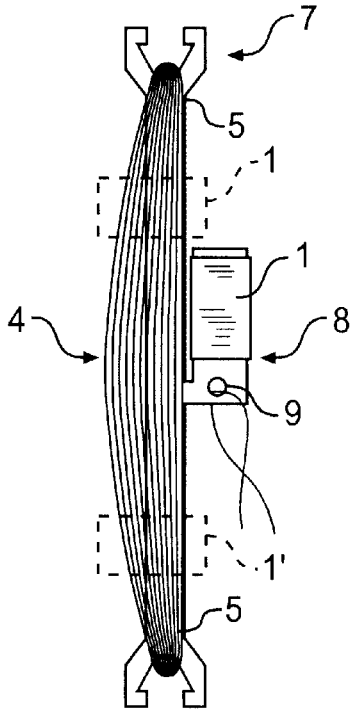
FIG. 2 is a plan view of the skein mounted on the embroidery bow of the FIG. 1.

The use of the bow is thus very simplified: all that is required is to pass one of the loops 5 of the skein 4 into one of the double hooks 7, then to remove the labels 1 and 1' existing around the said skein and finally to pass the other free end of the skein into the second double hook (cf. FIG. 2), thus ensuring that the yams do not entangle. This bow system therefore has the advantage of avoiding the step consisting in manually winding they are onto a support.

According to an advantageous characteristic of the invention, the bow 6 has, especially in its central part, an excrescence 8 of dimensions such that it can take the label (1 or 1') on which the reference of the skein (colour number, length, etc.) is indicated. Thus, after having mounted the skein on the said bow, the user slips the reference label onto the excrescence 8, thereby allowing him to rapidly identify in particular the colour of the skein with which he is working.

According to another advantageous characteristic of the invention, the said excrescence has, for example, in its lower part, a hole 9 intended for catching the unused strands of yarn.

The present invention as described above has many advantages; in particular, the bow described above can be used in combination with a label intended to go around a skein thereby allowing the yam to be mounted simply and instantly on the bow without any risk of the yam entangling. All that is required is to introduce one of the loops of the skein into a double hook 7, then to remove the labels containing the skein and to pass the other end of the skein into the second double loop.

What is claimed is:

1. A skein support bow comprising:

an elongated solid main section made of flexible material and having a length approximately equal to the length of a skein to be mounted thereon;

double hook members located at each end of the elongated main section for engaging a corresponding loop end of the skein;

an excrescence integrally appending from the main section and forming a label hanger for receiving a label after the label is removed from the skein thereby making information on the label available after the skein is mounted to the bow.

2. The support bow set forth in claim 1 wherein the excrescence has a hole formed therein for receiving loose strands of yam.

3. A method for mounting a skein onto a support bow comprising the steps:

removing labels encircling the skein;

introducing a first looped end of the skein onto a first double hook end of the bow;

introducing a second looped end of the skein onto a second double hook end of the bow; and hanging a removed skein label onto an excrescence integrally appending from an elongated solid main section of the bow thereby making data on the label available after the skein is mounted to the bow.

* * * * *